US005355145A

United States Patent [19]

Lucas

[11] Patent Number: 5,355,145

[45] Date of Patent: Oct. 11, 1994

[54] SATELLITE DISH ACTUATOR MOUNTING CONSTRUCTION

[76] Inventor: Donald E. Lucas, 2115 Kenyon, NW., Massillon, Ohio 44646

[21] Appl. No.: 922,630

[22] Filed: Jul. 30, 1992

[51] Int. Cl.[5] ..... H01Q 3/04

[52] U.S. Cl. ..... 343/882; 343/766

[58] Field of Search ..... 343/882, 765, 766, 878; 248/125, 183; H01Q 1/12, 3/02

[56] References Cited

U.S. PATENT DOCUMENTS 4,617,572 10/1986 Hugo ..... 343/766
4,799,064 1/1989 Nakamura ..... 343/766
4,918,363 4/1990 Hollis et al. ..... 343/882

FOREIGN PATENT DOCUMENTS 2120856 12/1983 United Kingdom ..... 343/882

*Primary Examiner*—Michael C. Wimer

*Assistant Examiner*—Tan Ho

*Attorney, Agent, or Firm*—Paul E. Milliken

[57] ABSTRACT

A satellite dish antenna mounting construction including a vertical support post having upper and lower ends, a pivotal polar mount member mounted on the upper end of the vertical support post, a satellite antenna dish frame pivotally mounted on the polar mount, a satellite antenna dish mounted on the dish frame, a power operated dish actuator having a motor and gear box housing with a motor and gear train mounted therein, an outer telescoping member extending downwardly from the gear box housing having an open outer and movable within and extending downwardly from the outer telescoping member, a clamp positioned on the vertical post at a position intermediate the upper and lower ends of the support post, a first universal pivot mount pivotally mounted to the clamp, and a second universal pivot mount pivotally mounted to the satellite dish frame at a position above the level of the location of the clamp.

4 Claims, 2 Drawing Sheets

SATELLITE DISH ACTUATOR MOUNTING CONSTRUCTION

FIELD OF THE INVENTION

The present invention relates to a television satellite reception antenna and more particularly to an antenna actuator mounting construction that is resistant to the weather elements.

BACKGROUND OF THE INVENTION

The use of dish antennas to receive television signals from satellites for personal use has become quite common. There are numerous satellites which relay television signals from ground located antennas to "dish" antennas located at an individual's home or other location for the private use of the television-receiving public. There are in excess of 30 satellites which orbit the earth approximately 23,000 miles in a stationary orbit about the equator. To receive the signals from the satellite, the homeowner's dish antenna must be aligned with the precise location along the equator of the particular satellite from which the television viewer desires to receive a signal . Each of the satellites will transmit or relay a number of different signals, and each satellite will normally include up to 24 transponders to relay up to 24 signals. Approximately 18 of the satellites using from 5 to 20 of the transponders provide the bulk of television transmission normally viewed by home viewers.

Since more than one satellite transmits signals which are of interest, the home viewer's television dish antenna must be moved from one position to another to align the dish with the particular satellite from which the viewer wishes to receive a signal. This reception is accomplished, therefore, by mounting the satellite dish on a mounting system which includes a polar mount; that is the satellite dish is mounted on a frame which rotates about an axis which is oriented parallel to the axis of rotation of the earth. Depending on the latitude of the location of the dish, the dish is oriented so that when rotated about the polar axis, the dish will scan along the equator upon which the various satellites are located. The satellite dish can, therefore, move from alignment with one satellite to another, each of the satellites being positioned at some point upon the equator approximately 23,000 miles out in space.

In the early days of satellite dish reception, the dish was moved manually from one satellite position location to another and this, of course, was at best a haphazard operation. More recently, powered automatic systems rotate the satellite dish about the polar mounting axis and various internal control devices automatically position the satellite dish to the optimum location.

These powered automatic systems all employ what is known in the art as an actuator. The actuator is basically a jack-type device which is connected or mounted on the frame at one point and at another upon the stationary portion of the mount. These jacks normally include a telescoping-type construction which includes a motor that operates a screw which in turn engages a nut that is attached to the inner tube of the telescoping actuator. The motor and screw assembly are located at one end of the outer tube of the telescoping assembly and thus operate the jack device.

Operation of the motor in one direction or the other will activate the screw device to move the telescoping inner tube either toward or away from the motor. Thus, the inner tube slides inwardly and outwardly within the outer tube of the jack or actuator construction and, being attached to the dish frame, will rotate the dish about the polar axis upon which the dish is mounted. In the trade, this polar axis is also called the "dish axis".

In all constructions of which I am aware in the prior art, the inner tube of the actuator is connected by a pivotal mount of a universal type to the dish frame and the outer tube of the actuator is attached to the stationary mount of the satellite dish mounting system. This stationary mount normally includes a vertical post and the outer tube is attached to this by a plurality of bracket members, which are attached to the stationary frame which is a part of the vertical post.

Because of the manner in which the actuator is attached both to the stationary mounting assembly and the dish frame which is movable about the polar axis, and the dish being positioned at an angle to scan the equator, the actuator is angled upwardly the proper number of degrees depending upon the latitude of the location of the receiver.

As the satellite dish is moved from one position to another so that the signals from different satellites may be received, the inner tube of the actuator mechanism slides inwardly and outwardly within the outer tube of the actuator mechanism. After a period of time wear, caused by this constant inward and outer motion of the inner tube, permits various weather elements such as rain, sleet and snow to enter the jack mechanism. In an attempt to prevent problems from occurring, actuators include drainage holes in the motor and gear box housing so that this moisture can be drained from the mechanism. The provision of drainage holes normally will prevent problems from occurring; however, in actual practice, after a period of time, because of the wear, caused by the continual inward and outward movement of the inner tube member of the telescoping construction, as well as the accumulation of dirt and other foreign matter, a situation will exist in which moisture will accumulate within the gear box and telescoping tube members of the actuator.

When this happens, at locations where freezing temperatures are encountered, the accumulated moisture will freeze and prevent movement of the actuator or cause damage to either the gears which operate the screw or the screw device itself.

Under such conditions, the actuator must either be repaired or thawed to allow proper actuator operation. Efforts to alleviate the problems have included the provision of a weather resistant rubber boot which is placed around the outer exposed end of the outer tube at the position where the inner tube slides inwardly and outwardly in the outer tube. These boots, while being an improvement over no protection, are less than satisfactory and the actuators are still subject to the same problems of moisture accumulation primarily because of the wear to the boot caused by the continual inward and outward movement of the inner tube as the actuator moves or rotates the satellite dish from one position to another.

U.S. Pat. No. 4,918,363 discloses a typical example of the prior art devices which are subject to the aforementioned problems. The device disclosed in this reference includes an electrically powered motor which drives a series of gears that turns a worm gear assembly to move an inner telescoping member within an outer telescoping member to either elongate or shorten the actuator length, thereby rotating the satellite dish about a polar axis so that the dish may be aligned to a desired satellite position. The actuator or jack disclosed in this reference shows the motor and gear assembly mounted within housing members and located at the lower end of the jack. As seen in FIG. 1 of this reference, as the motor turns the worm gear assembly, the inner tubular member is moved inwardly or outwardly and the dish is thereby rotated. As can be seen in FIG. 8 of this reference, the juncture between the inner and outer tube appears to be protected by the aforementioned rubber boot. However, because of the jack's positioning, as shown in FIG. 1, moisture will eventually enter the interior of the telescoping tube construction and likewise enter the gear box area with the resulting problems associated with the moisture freezing.

Accordingly, there is an unsatisfied need for a satellite actuator or jack mounting construction which will eliminate the problems caused by the accumulation of moisture within the interior of the telescoping jack. It is, therefore, a primary object of the present invention to provide a jack mounting construction which is not susceptible to problems caused by the accumulation of moisture within the interior of the actuator construction.

It is a further object of the present invention to provide a satellite antenna actuator mounting construction in which the motor or drive system of the jack is mounted directly to the satellite dish frame, and in which the inner tubular telescoping member of the construction is attached to the upright support member whereby the open end of the outer actuator tubular member, through which the inner tubular member passes, faces downwardly to prevent the accumulation of moisture within the interior of the jack construction.

It is a further object of the present invention to provide a mounting bracket for attaching the housing end of the actuator construction directly to the frame of a satellite dish.

These and other objects and advantages will be apparent from the construction of the mounting mechanism of the present invention, the general nature of which may be stated as a power driven telescoping actuator construction having a housing enclosing a motor and gear mechanism, an outer tubular member extending from said housing, a gear member connected to an inner tubular member which is extendible and retractable, said housing end of said outer tubular member being attached to the frame of a satellite dish which is pivotally mounted on a polar axis and the outer end of the inner tubular member being attached to an upright dish support member whereby extension or retraction of the inner tubular member within the outer tubular member will rotate the satellite dish about the polar axis.

DESCRIPTION OF THE PREFERRED EMBODIMENTS

Preferred embodiments of the present invention are illustrated in the accompanying drawings and the advantageous, new and useful results are contained in the following description.

In the drawings.

Similar numerals refer to similar parts throughout the various figures of the drawings.

Figure 1:
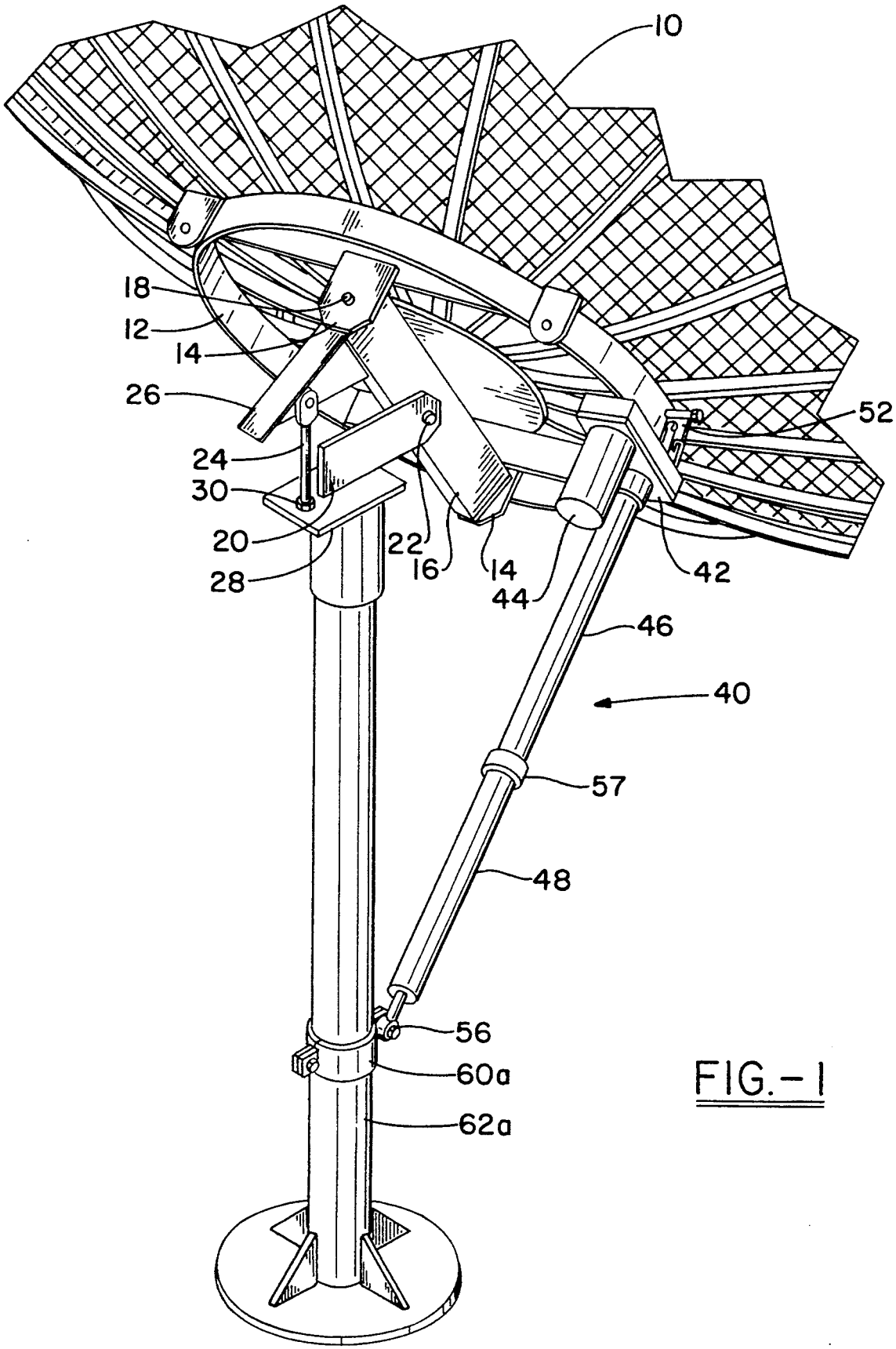
FIG. 1 illustrates the satellite actuator mounting construction of the present invention with the dish partially broken away and illustrating the unique mounting of the actuator between the antenna dish frame and upright support member.

Referring now specifically to FIG. 1, a satellite dish receiver antenna is illustrated and includes a parabolic dish 10 which is mounted on a dish frame 12. A pair of brackets 14 are attached to frame 12 and have extending therebetween polar axis member 16 which is pivoted in brackets 14 at each end as at 18. Axis member 16 is attached to support bracket 20 through pivotal mounting 22. Adjustable member 24 is positioned to orient the proper angle of polar axis member 16 with respect to the vertical and extends between bracket 26 and support plate 28. Adjustment of nut 30 on adjustable member 24 provides a means to set the polar axis at exact degree so that rotation of dish 10 about the polar axis 16 will position dish 10 to scan the equator on which the various transmitters are located.

The above described polar axis mounting constructions are all well known in the prior art and different forms of polar mountings are commercially available and perform essentially the same functions, which is to properly orient the polar axis of the antenna so that rotation of the antenna about the polar axis scans the equator.

In accordance with the present invention, the rotation of the dish about the polar axis is accomplished by a power driven actuator or jack generally indicated at 40. This actuator includes a gear housing 42, a motor housing 44, and an outer telescoping member 46 extending from gear housing 42. Mounted within outer telescoping tubular member 46 is an inner telescoping member 48 which may be moved within outer telescoping member 46 by action of a motor, not shown, contained within motor housing 44 which in turn drives a gear system, not shown, contained in gear housing 42. The actuator mounting construction of the present invention also includes a gear housing pivot member 50 (shown in FIGS. 2 and 3) which is attached to gear housing 42 and includes a universal pivot member 52 which, in accordance with the present invention, is attached directly to frame 12 of the satellite dish antenna.

The outer end of inner telescoping member 48 is provided with a universal pivot member 56 which, as shown in FIG. 1, is attached to a bracket **60*a* which is fixedly mounted to upright support 62*a*. The outer end 57 of outer tubular member 46, as shown in FIG. 1, faces in a direction downwardly from the satellite dish. Thus, moisture and other weather elements cannot enter the interior of tubular member 46** since the moisture or other elements will either drain away or fall away from the device.

Figure 2:
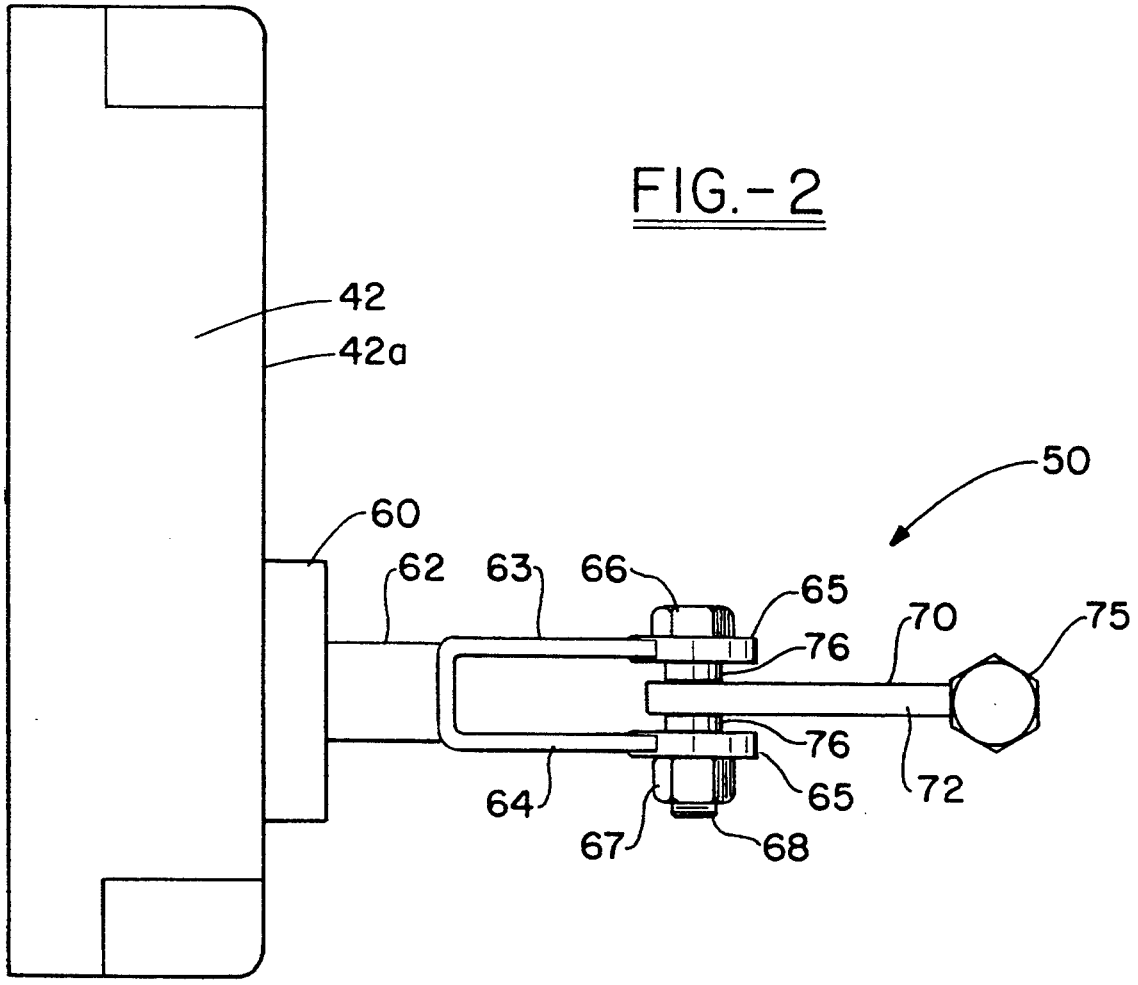
FIG. 2 illustrates a plan view of the assembly and pivots which connect the gear box housing to the dish frame.
Figure 3:
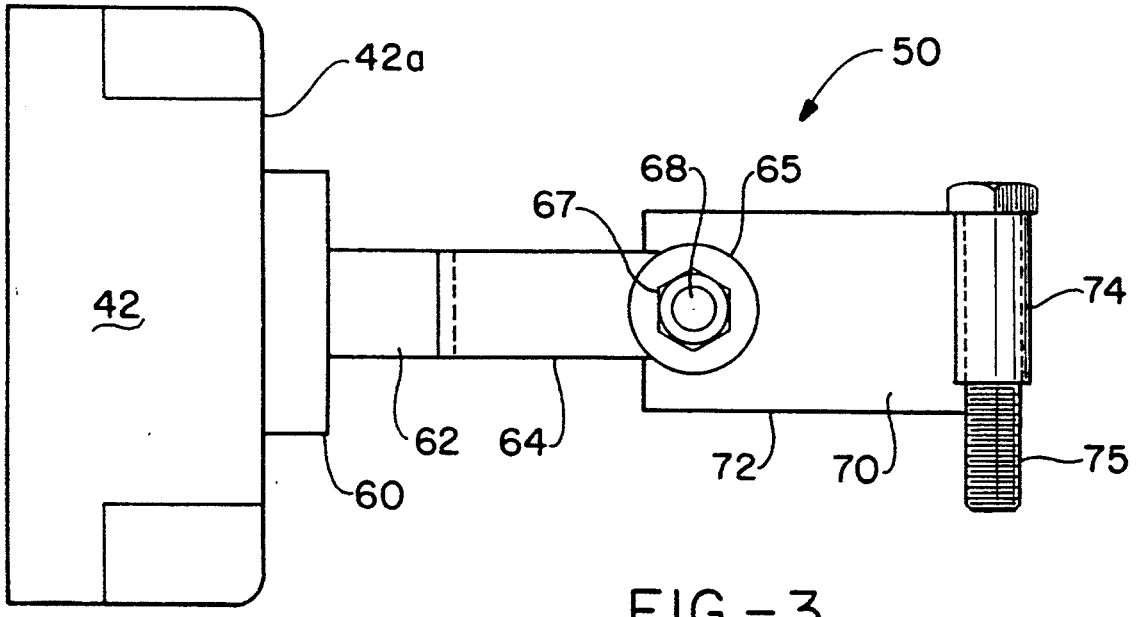
FIG. 3 is a top view of the assembly shown in FIG. 2.

FIGS. 2 and 3 illustrate in detail the construction of the means by which gear box 42 and outer tubular member 46 are attached to frame 12. Gear Box 42 includes a mounting plate 60 which is mounted to the upwardly and outwardly oriented face **42*a* of gear box 42. A yoke member 62 extends from and is attached to mounting plate 60 and includes yoke arms 63 and 64 which are spaced apart from each other and terminate in a pivot means 65 which includes openings formed therein. A pivot pin 66 extends through the openings formed in pivot means 65 and may be in the form of a nut 67 and bolt 68**.

The mounting means also includes a frame bracket 70 which includes a bracket plate 72 and bracket pivot which is in the shape of a tubular member 74 attached to plate 72. Bracket 70 is attached to frame 12 by bolt 75. Bolt 75 is fixedly attached to frame 12 by mounting in an opening formed in frame 12. Bolt 75 passes through tubular member 74 and permits the pivoting of bracket 70 about the axis of bolt 75.

The axis of bolt 67 serves as the pivot axis for yoke member 62. Bolt 67 also passes through an opening formed in bracket plate 72 and permits pivoting of yoke 62 with respect to bracket 70 about the axis defined by the axis of bolt 67. The mounting means includes two pivot axes, one which is defined by the axis of bolt 67, and the second which is defined by the axis of bolt 75. These axes are perpendicular to each other and provide for the pivoting of frame 12 and gear box 42 and tubular member 46 with respect to each other in a universal manner. This universality of pivot capability permits the rotation of frame 12 about the polar axis of the unit from horizon to horizon.

The spaced yoke arms 63 and 64 straddle bracket plate 72 at the pivot area and it is preferable to provide as little play as possible between the yoke arms 63 and 64 and bracket plate 72. This may be accomplished by several alternative means. First, the thickness of bracket plate 72 may be just slightly smaller than the distance between yoke arms 63 and 64. Alternately, as shown in FIG. 2, sleeves 76 may be placed between bracket 70 and each of yoke arms 63 and 64. Sleeves 76 will act as spacers for preventing sliding movement of bolt 67 and the opening in bracket plate 72 through which bolt 67 passes.

The antenna mounting construction of the present invention provides an antenna mounting and moving actuating system which avoids the prime problem of the prior art, that is, the entrance of moisture into the antenna actuator. Additionally, because the antenna actuator extends between the frame of the antenna dish and the vertical ground support member, a stronger construction than that available in prior art constructions is provided.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved satellite dish actuator mounting construction is constructed, assembled and operated, the characteristics of the new construction, and the advantageous, new and useful results obtained; the new and useful structures, devices, elements, arrangements, parts, and combinations are set forth in the appended claims.

I claim:

1. Satellite dish antenna mounting construction including a vertical support post having upper and lower ends, said lower end being mounted on a supporting surface, a pivotal polar mount member mounted on the upper end of the vertical support post, a satellite antenna dish frame pivotally mounted on the polar mount, a satellite antenna dish mounted on the dish frame, a power operated dish actuator having a motor and gear box housing with a motor and gear train mounted therein, an outer telescoping member extending downwardly from the gear box housing and having an open outer end, an inner telescoping member having an outer end movable within and extending downwardly from the outer telescoping member in response to operation of the motor and gear train, clamping means positioned on the vertical post at a position intermediate the upper and lower ends of the support post, a first universal pivot mount extending from the outer end of the inner telescoping member, a second universal pivot mount attached adjacent to the gear box housing, said first universal pivot mount pivotally mounted to the clamping means, and the second universal pivot mount pivotally mounted to the satellite dish frame at a position above the level of the location of the clamping means.

2. Satellite dish antenna mounting construction as defined in claim 1 in which said second universal pivot mount includes yoke means mounted on the gear box housing and a pivot bracket mounted to the frame, and in which the yoke means is pivotally attached to the pivot bracket.

3. Satellite dish antenna mounting construction as defined in claim 2 in which the pivot bracket is pivotally attached to the frame.

4. Satellite dish antenna mounting construction as defined in claim 3 in which a pivot axis of the yoke means is perpendicular to a pivot axis of the pivot bracket.

* * * * *